US007941958B1

(12) United States Patent
Zedrosser

(10) Patent No.: US 7,941,958 B1
(45) Date of Patent: May 17, 2011

(54) FIREARM WITH A SIMPLIFIED DISASSEMBLY

(75) Inventor: Ulrich Zedrosser, Steyr (AT)

(73) Assignee: Fabbrica D'Armi Pietro Beretta S.p.A., Gardone Val Trompia (IT)

( * ) Notice: Subject to any disclaimer, the term of this patent is extended or adjusted under 35 U.S.C. 154(b) by 271 days.

(21) Appl. No.: 12/245,177

(22) Filed: Oct. 3, 2008

(30) Foreign Application Priority Data

Oct. 4, 2007 (IT) ..... MI2007A1912

(51) Int. Cl.
*F41A 21/00* (2006.01)

(52) U.S. Cl. ..... 42/75.03; 42/75.01

(58) Field of Classification Search ..... 42/75.01, 42/75.03
See application file for complete search history.

(56) References Cited

U.S. PATENT DOCUMENTS

| | | | | | |
|---|---|---|---|---|---|
| 1,376,834 | A * | 5/1921 | Sheppard | 89/153 |
| 1,828,108 | A * | 10/1931 | Flowers | 89/144 |
| 1,993,887 | A * | 3/1935 | Kewish | 89/144 |
| 3,731,417 | A * | 5/1973 | Moller et al. | 42/75.03 |
| 4,730,407 | A * | 3/1988 | DeCarlo | 42/84 |
| 5,483,766 | A * | 1/1996 | Hochstrate et al. | 42/75.03 |
| 6,739,082 | B2 * | 5/2004 | Christensen | 42/6 |
| 6,901,691 | B1 * | 6/2005 | Little | 42/118 |
| 7,131,228 | B2 * | 11/2006 | Hochstrate et al. | 42/75.01 |
| 7,685,757 | B2 * | 3/2010 | Rohrauer | 42/75.01 |
| 2004/0020092 | A1 * | 2/2004 | Christensen | 42/49.01 |
| 2005/0262752 | A1 * | 12/2005 | Robinson et al. | 42/71.01 |
| 2006/0283067 | A1 * | 12/2006 | Herring | 42/75.01 |
| 2007/0051236 | A1 * | 3/2007 | Groves et al. | 89/142 |
| 2007/0199435 | A1 * | 8/2007 | Hochstrate et al. | 89/191.02 |
| 2009/0031607 | A1 * | 2/2009 | Robinson et al. | 42/16 |
| 2009/0151213 | A1 * | 6/2009 | Bell | 42/69.03 |
| 2009/0288324 | A1 * | 11/2009 | Peterson et al. | 42/75.03 |
| 2010/0162604 | A1 * | 7/2010 | Dubois | 42/18 |
| 2010/0170130 | A1 * | 7/2010 | Tertin | 42/69.02 |

* cited by examiner

*Primary Examiner* — Troy Chambers
*Assistant Examiner* — Samir Abdosh
(74) *Attorney, Agent, or Firm* — Oblon, Spivak, McClelland, Maier & Neustadt, L.L.P.

(57) ABSTRACT

A firearm, in particular an automatic or semi-automatic rifle, with a simplified disassembly, including a receiver, a barrel, a bolt assembly, a foldable stock and a removable lower receiver with a magazine and a release mechanism, is equipped with a lower receiver inserted with shape coupling in the lower open part of the receiver between a front seat and a rear seat of the receiver, wherein the front seat, coupled with at least one complementary surface of the lower receiver, forms a front articulation for the rotation of the lower receiver with respect to the receiver, also including a mechanism for blocking the lower receiver in at least two different positions.

6 Claims, 4 Drawing Sheets

FIREARM WITH A SIMPLIFIED DISASSEMBLY

BACKGROUND OF THE INVENTION

1. Field of the Invention

The present invention relates to a firearm with a simplified disassembly.

2. Discussion of the Background

In the daily use of a firearm, in particular an automatic or semi-automatic rifle for military use, it has proved to be extremely important for the user to be able to rapidly open the receiver in the rear part without having to previously remove components. These operations are necessary, for example, for verifying that the barrel hole is free or to effect the necessary cleaning after removing the bolt assembly from the rear part of the rifle.

In most known automatic rifles, a lower receiver which forms the closure of the receiver is removably connected to this. The lower receiver, for example, can be "L"-shaped and the short side is used as a rear closure of the receiver and also as a stop buffer of the bolt assembly. In this type of rifle, the stock can, for example, be connected to the receiver, integrally or foldably. The rear part of the lower receiver, in firearms in which this forms the rear closure, generally does not have any reinforcing connection with the receiver. This is only possible for metal receivers.

The rear closing of the receiver exerts an extremely important function in terms of safety. It must in fact be capable of reliably stopping the withdrawal of the bolt pushed at a high velocity by the firing gases. The user, whose face is flanked alongside the receiver, must not be exposed to risk.

This circumstance requires suitably sized receivers in addition to closing elements which negatively influence the weight of the firearm.

A requisite of new-generation automatic rifles is, among other things, a reduction in weight of the firearm, in order to be able to integrate modern firing control systems without increasing the overall weight of the firearm. To satisfy this request, materials such as steel and also aluminum must be excluded for numerous uses. These materials must be substituted by suitable synthetic materials without neglecting however aspects which are important for safety.

SUMMARY OF THE INVENTION

An objective of the present invention is to provide a firearm, in particular an automatic or semi-automatic firearm, with a simplified disassembly which does not comprise loose assembly components and/or which require the use of particular tools.

A further objective of the present invention is to provide a light firearm with a simplified disassembly comprising the highest possible number of components made of synthetic material.

Another objective is to provide a firearm with a simplified disassembly equipped with a rear closing portion of the receiver having a high resistance and safety.

Yet another objective of the present invention is to provide a firearm with a simplified disassembly which is particularly simple and functional, with reduced costs.

These objectives according to the present invention are achieved by providing a firearm with a simplified disassembly as specified in claim 1.

Further characteristics are indicated in the dependent claims.

BRIEF DESCRIPTION OF THE DRAWINGS

The characteristics and advantages of a firearm with a simplified disassembly according to the present invention will appear more evident from the following illustrative and non-limiting description, referring to the enclosed schematic drawings, in which.

DETAILED DESCRIPTION OF THE PREFERRED EMBODIMENTS

Figure 1:
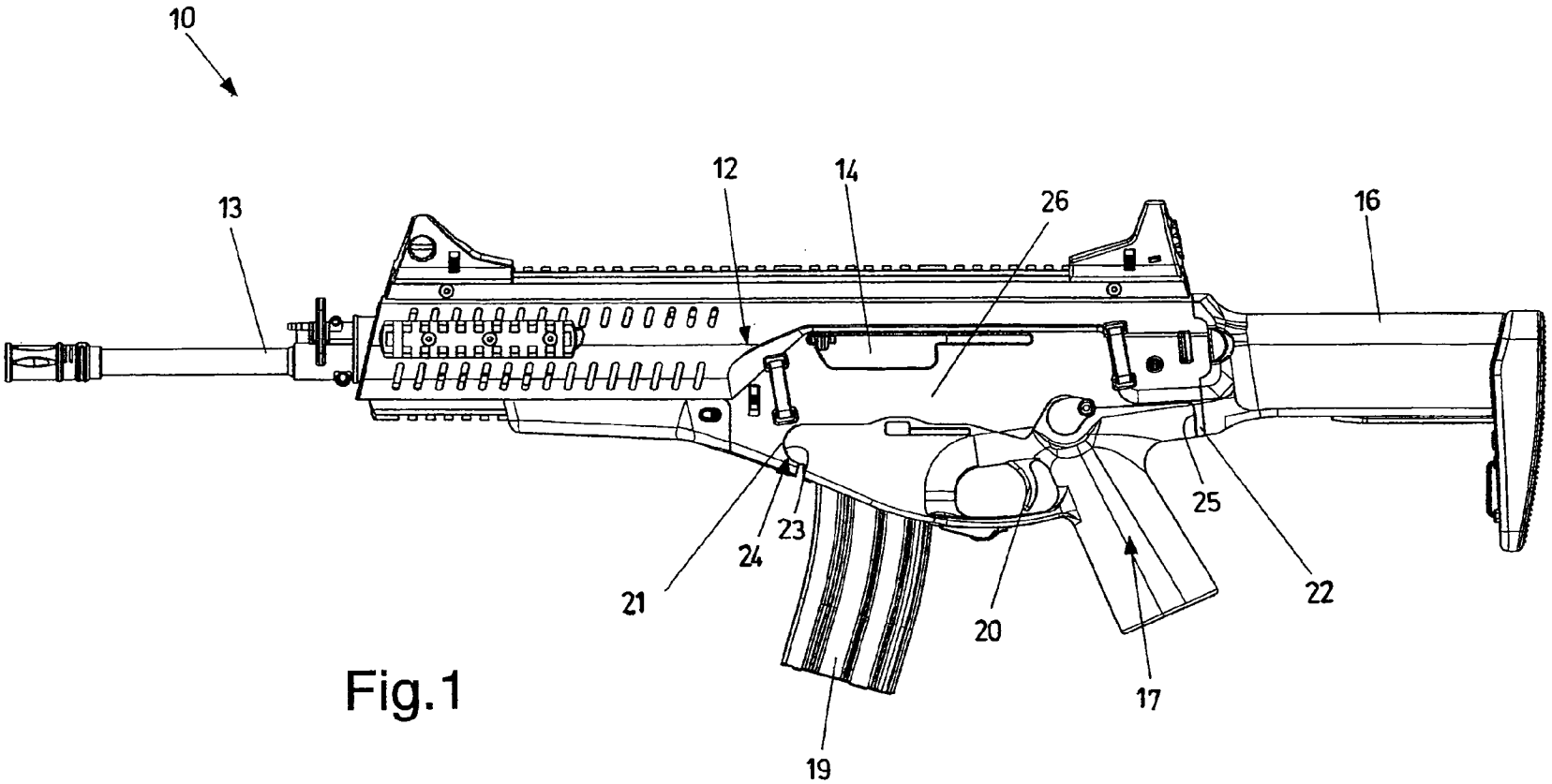
FIG. 1 is a raised side view of a firearm in the form of an automatic or semi-automatic rifle with a simplified disassembly, according to the present invention, in an assembled position.

With reference to the figures, these show a firearm, in the form of an automatic or semi-automatic rifle, with a simplified disassembly indicated as a whole with 10 and comprising a receiver 12, a barrel 13, a bolt assembly 14 equipped with an inertial spring 15, a foldable stock 16 and a lower receiver 17.

The receiver 12 is made of a single piece in a synthetic material and is open at the front, in the direction of the barrel 13, and at the back towards the stock 16. The barrel 13 is removably inserted at the front and the bolt assembly 14 is inserted at the back.

Figure 3:
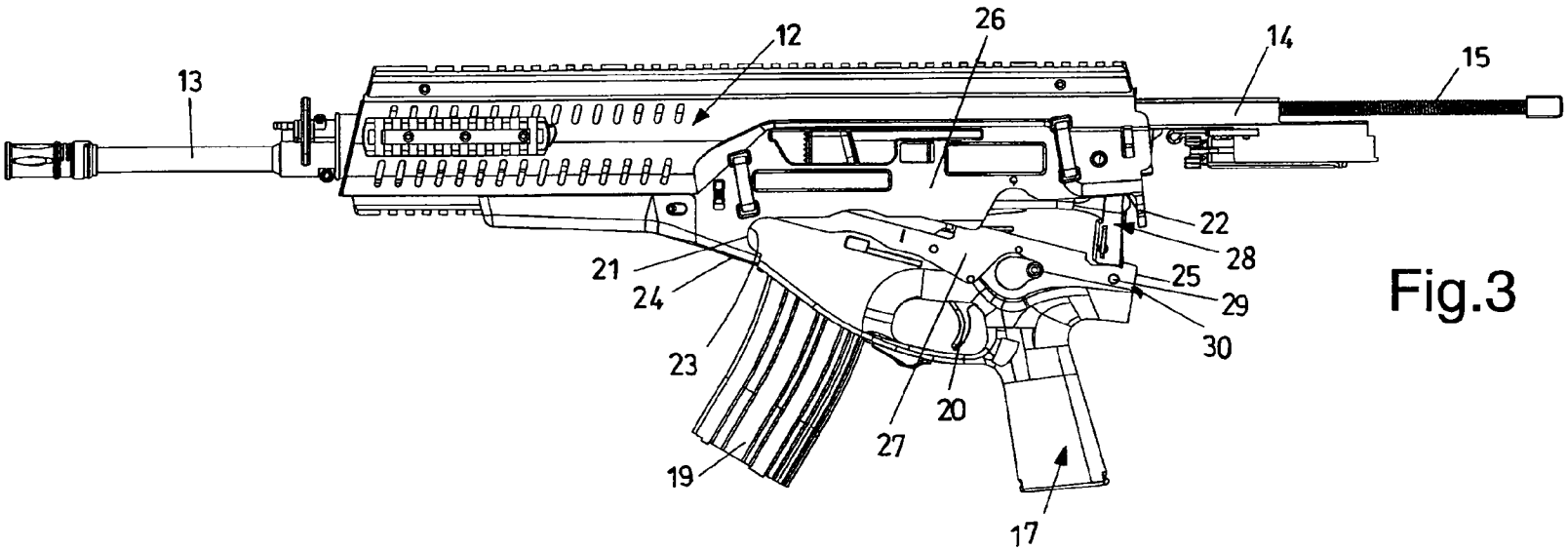
FIGS. 3 and 4 are a raised side view and a plan view respectively of an automatic or semi-automatic rifle according to the invention in an open position.
Figure 4:
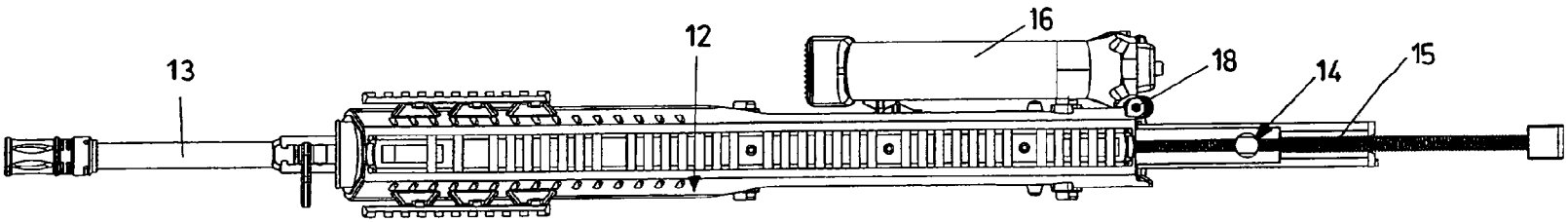

The bolt assembly 14, which in FIGS. 3 and 4 is shown partially extracted from the rifle 10 when open, is withheld in position when the rifle is closed by a rear portion of the lower receiver 17.

The foldable stock 16 is rotatingly constrained to the receiver by means of a substantially vertical pin 18 situated on one side of the receiver 10 at its rear end, as shown in FIG. 4.

Figure 2A:
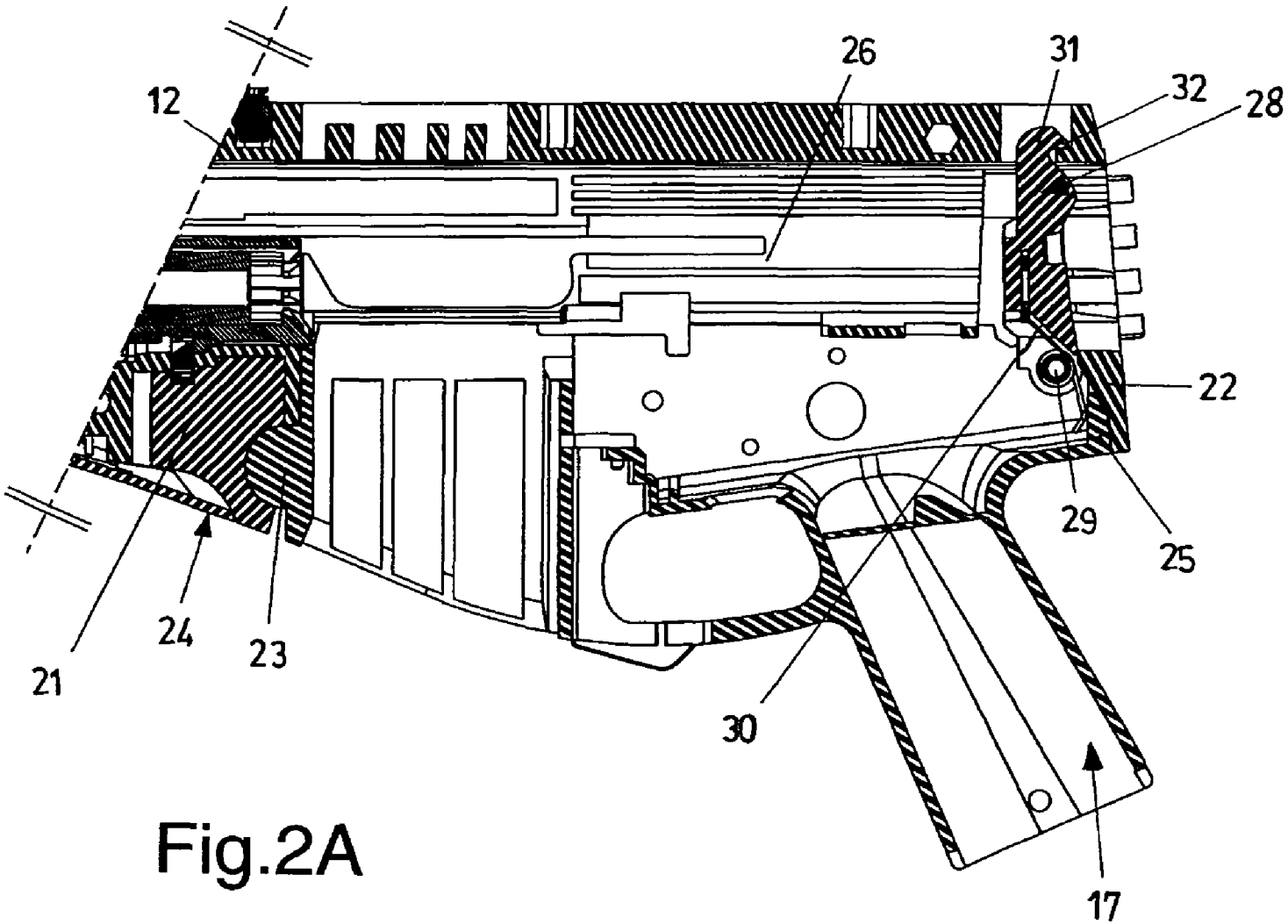
FIGS. 2A and 2B are transversal sections of an enlarged detail of the rifle of FIG. 1 in a closed and open position respectively.

When in a closed position, for example as shown in FIG. 1 and in the section of FIG. 2A, the stock 16 forms a further rear closing element of the receiver 12.

The lower receiver 17 containing a magazine 19 and a release mechanism 20, is applied on the lower side of the receiver 12, which is also open.

The lower receiver 17 can be inserted in proportion with shape coupling between a front seat 21 and a rear seat 22 of the receiver 12 and can be rotated with respect to this with the fulcrum close to the front end.

The front seat 21 of the receiver 12 comprises at least one radial surface, i.e. a concave surface with a constant radius, which is engaged by shape coupling with at least one complementary radial surface 23 of the lower receiver 17 situated at its front end, to form a front articulation 24 for the rotation of the lower receiver 17 with respect to the receiver 12, as shown in FIGS. 1 and 3.

A rear end 25 of the lower receiver 17 is buffered, with the arm closed, against the rear seat 22 of the receiver 12 which forms a rear stop for the lower receiver 17 (FIG. 2A).

Side walls 26 of the receiver 12, which is open below, are superimposed with respect to side walls 27 of the lower receiver 17, when this is inserted in the receiver. The overlying position of the walls is advantageous as the pins of the release mechanism 20 are safely kept in position by the walls of the receiver 26 during firing.

The rear portion of the lower receiver 17 which forms the rear closure of the receiver 12 consists of a plate 28 hinged to a transversal pin 29 constrained to the lower receiver 17 near its rear end.

Figure 2B:
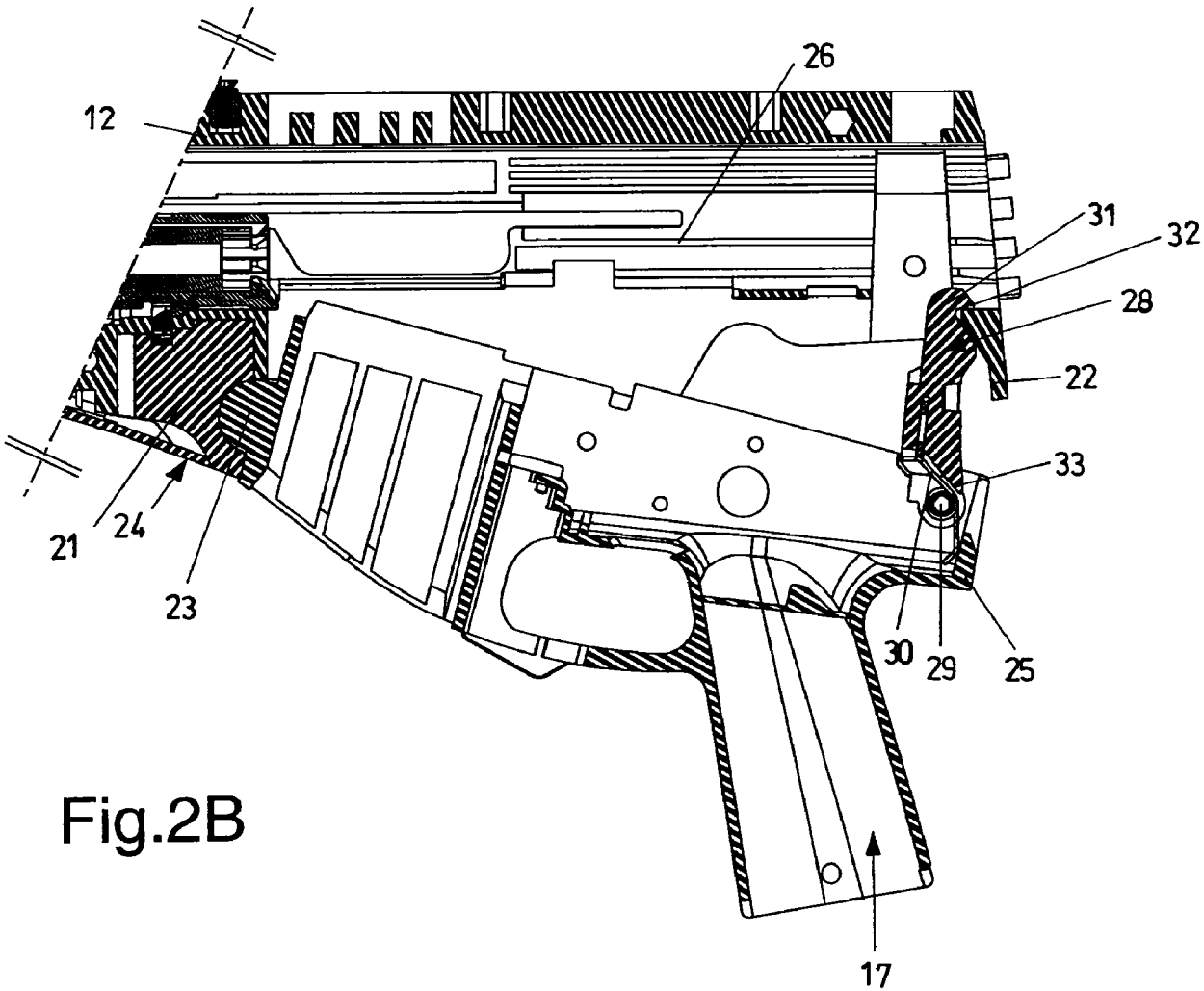

The plate 28 can be rotated around the pin and is loaded in closing by a spring 30, at least in an open firearm position (FIG. 2B). The opposite ends of the spring 30 are respectively positioned on a front side of the plate 28 and on the rear end 25 of the lower receiver 17.

The plate 28 is supported by the side walls 26 of the receiver and is provided at the upper end with an engagement element 31 with the receiver 12, which opposes the rotating movement of the lower receiver 17, forming blocking means of the lower receiver 17 in at least two different positions, i.e. in the closed and open firearm position, shown respectively in the sections of FIGS. 2A and 2B.

The engagement element 31 is alternatively hooked with a first upper toothed element 32 of the receiver, in a closed position of the rifle (FIG. 2A), or with a second toothed element 33 of the receiver, in an open position of the rifle (FIG. 2B).

In a lower receiver 17 of synthetic material, the rear plate 28, also made of synthetic material, is supported at the back by the receiver 12 and acts as a stopper for the bolt assembly 14 in its withdrawal.

The opening and disassembly of the receiver 12 for the inspection or cleaning of the barrel 13 is obtained, after opening the stock 16, by pushing the plate 28 forwards to overcome the action of the spring and then rotating the lower receiver 17 downwards without the removal of loose assembly components. The lower receiver 17 remains engaged in the receiver 12 by means of the engagement element 31 of the plate 28 (FIGS. 3 and 4).

By pushing the plate 28 forwards again to overcome the force of the spring 30, the lower receiver 17 can be further rotated downwards and then separated from the receiver 12, if the complete disassembly of the firearm is necessary.

The automatic or semi-automatic rifle with a simplified disassembly, object of the present invention, has the advantage of being equipped with a rear closing element of the receiver which is shock resistant and safe, suitable for a receiver made of synthetic material, in which a lower receiver made of synthetic material is inserted.

Furthermore, the kinetic energy obtained from the stoppage of the withdrawing bolt is advantageously transmitted directly from the rear plate to the side walls of the receiver reducing the tensions in the lower receiver. Consequently, also with synthetic materials, there are sufficient safety margins with respect to overloading.

The opening and disassembly of the receiver for the inspection or cleaning of the barrel is effected by simply pushing the plate forwards and then rotating the lower receiver downwards without the disassembly of loose components. The lower receiver remains engaged in the receiver by means of the hooking element of the plate to allow the firearm to be inspected and cleaned even without removing the lower receiver.

The lower receiver is separated from the firearm only if necessary, and even in this case the process is extremely simple, i.e. by pushing the plate forwards again and rotating the lower receiver.

A further advantage of the firearm, in the form of an automatic or semi-automatic rifle, according to the invention, is that with the stock closed, the plate is protected against undesired activations and further sustained in the impact direction of the bolt.

The firearm with a simplified disassembly thus conceived can undergo numerous modifications and variants, all included in the invention; furthermore, all the details can be substituted by technically equivalent elements. In practice, the materials used, as also the dimensions, can vary according to technical requirements.

The invention claimed is:

1. A firearm with a simplified disassembly, comprising a receiver, a barrel, a bolt assembly, a foldable stock and a removable lower receiver comprising a magazine and a release mechanism, wherein said lower receiver is inserted with shape coupling in the lower open part of said receiver between a front seat and a rear seat of the receiver, wherein said front seat, coupled with at least one complementary surface of said lower receiver, forms a front articulation for the rotation of said lower receiver with respect to the receiver, also comprising blocking means of the lower receiver in at least two different positions, said firearm further comprising a plate hinged close to the rear end of said lower receiver, said plate forming the rear closure of the receiver for the buffer stopping of the withdrawal of said bolt assembly, and wherein said blocking means comprise an engagement element situated at the upper end of said plate for engagement with a first upper toothed element of the receiver, in a closed firearm position, or with a second lower toothed element of the receiver, in an open firearm position, respectively.

2. A firearm with a simplified disassembly, comprising a receiver, a barrel, a bolt assembly, a foldable stock and a removable lower receiver comprising a magazine and a release mechanism, wherein said lower receiver is inserted with shape coupling in the lower open part of said receiver between a front seat and a rear seat of the receiver, wherein said front seat, coupled with at least one complementary surface of said lower receiver, forms a front articulation for the rotation of said lower receiver with respect to the receiver, also comprising blocking means of the lower receiver in at least two different positions, said firearm further comprising a plate hinged close to the rear end of said lower receiver, said plate forming the rear closure of the receiver for the buffer stopping of the withdrawal of said bolt assembly, and wherein said plate is loaded in the closing by a spring at least in one open firearm position.

3. A firearm with a simplified disassembly, comprising a receiver, a barrel, a bolt assembly, a foldable stock and a removable lower receiver comprising a magazine and a release mechanism, wherein said lower receiver is inserted with shape coupling in the lower open part of said receiver between a front seat and a rear seat of the receiver, wherein said front seat, coupled with at least one complementary surface of said lower receiver, forms a front articulation for the rotation of said lower receiver with respect to the receiver, also comprising blocking means of the lower receiver in at least two different positions, said firearm further comprising a plate hinged close to the rear end of said lower receiver, said plate forming the rear closure of the receiver for the buffer stopping of the withdrawal of said bolt assembly, wherein said plate is loaded in the closing by a spring at least in one open firearm position, and wherein said blocking means comprise an engagement element situated at the upper end of said plate for engagement with a first upper toothed element of the receiver, in a closed firearm position, or with a second lower toothed element of the receiver, in an open firearm position, respectively.

4. The firearm according to claim 1, wherein said front articulation comprises at least one concave front seat with a constant radius in the receiver and at least one complementary radial surface of the lower receiver.

5. The firearm according to claim 1, wherein said rear seat of said receiver forms a rear stop for the resting of a rear end of the lower receiver.

6. The firearm according to claim 1, wherein side walls of the receiver are superimposed with respect to side walls of the lower receiver when the lower receiver is inserted in the receiver.

* * * * *